US007483655B2

(12) United States Patent
Tatsumi et al.

(10) Patent No.: US 7,483,655 B2
(45) Date of Patent: Jan. 27, 2009

(54) DEVELOPING UNIT WITH A HOUSING ASSEMBLY

(75) Inventors: Eiji Tatsumi, Osaka (JP); Takahisa Nakaue, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 300 days.

(21) Appl. No.: 11/380,425

(22) Filed: Apr. 27, 2006

(65) Prior Publication Data

US 2006/0245793 A1 Nov. 2, 2006

(30) Foreign Application Priority Data

Apr. 28, 2005 (JP) ..... 2005-133093

(51) Int. Cl.
*G03G 15/08* (2006.01)

(52) U.S. Cl. ..... 399/254; 399/256

(58) Field of Classification Search ..... 399/254, 399/256, 273, 283

See application file for complete search history.

(56) References Cited

U.S. PATENT DOCUMENTS

| | | | | |
|---|---|---|---|---|
| 2004/0033083 | A1 * | 2/2004 | Fukuyama et al. | 399/254 |
| 2006/0245791 | A1 * | 11/2006 | Tatsumi et al. | 399/254 |

FOREIGN PATENT DOCUMENTS

| | | | | |
|---|---|---|---|---|
| JP | S58-44467 | A | | 3/1983 |
| JP | 02226272 | A | * | 9/1990 |
| JP | 4/60665 | A | | 2/1992 |
| JP | H07-49617 | A | | 2/1995 |
| JP | 10/123816 | A | | 5/1998 |
| JP | 2002/148915 | A | | 5/2002 |
| JP | 2002-287472 | A | | 10/2002 |
| JP | 2005-92092 | A | | 4/2005 |

* cited by examiner

*Primary Examiner*—Susan S Lee
(74) *Attorney, Agent, or Firm*—Shinjyu Global IP

(57) ABSTRACT

A developing unit in an image forming device is disclosed which includes a first agitation transport member, a second agitation transport member, a bulkhead, and a housing. The second agitation transport member is arranged to be parallel to the first agitation transport member in the horizontal direction, and configured to simultaneously agitate and transport developer in cooperation with the first agitation transport member and mix developer with the externally supplied toner. The bulkhead has a partition member arranged between the first agitation transport member and the second agitation transport member, and a guide member that is formed to be integrated with the partition member and guide developer peeled off from the developing roller to the first agitation transport member. The bulkhead can arranged in the housing such that there is no space between first and second ends of the bulkhead and the housing.

3 Claims, 2 Drawing Sheets

DEVELOPING UNIT WITH A HOUSING ASSEMBLY

CROSS-REFERENCE TO RELATED APPLICATIONS

This application claims priority to Japanese Patent Application No. 2005-133093. The entire disclosure of Japanese Patent Application No. 2005-133093 is hereby incorporated herein by reference.

BACKGROUND OF THE INVENTION

Field of the Invention

The present invention relates to a developing unit.

An electrophotographic image forming device such as a laser printer or a copying machine has a photosensitive drum and a developing unit that provides toner to the surface of the photosensitive drum. The developing unit also includes a developing roller that draws developer onto the surface thereof, and an agitation transport member that agitates developer and simultaneously transports the same in the axial direction and provides it to the developing roller. In addition, the developing roller generally includes a plurality of magnetic poles, including a drawing magnetic pole that draws developer to the surface of the developing roller and a peel-off magnetic pole that peels off the developer after passing by a developing region in which toner is supplied to the photosensitive drum from the surface of the developing roller.

Japan Patent Application Publication JP-A-04-060665 discloses the above described type of developing unit, which includes a first agitation transport member and a second agitation transport member, both of which are arranged parallel to each other in a horizontal direction, and a developing roller arranged above the first and the second agitation transport members. According to this developing unit, the two agitation transport members are arranged parallel to each other. Therefore, it is possible to manufacture the entire developing unit to be slim. In addition, according to this developing unit, it is possible to arrange the developing unit below the photosensitive drum. Thus, it is possible to miniaturize the image forming device in the lateral direction.

However, in this developing unit, the developer contained in the first agitation transport member side is drawn to the developing roller and transported to the developing region. The remaining developer is peeled off from the surface of the developing roller after passing the developing region, and is dropped on the second agitation transport member side. As a result, the quantity of developer increases on the second agitation transport member side. On the other hand, the amount of the developer on the first agitation transport member side decreases. Thus, the quantity of the developer on the two agitation transport member sides will become imbalanced. Accordingly, the density of the developed image may decrease, or the developer may overflow out of the second agitation transport member side.

In order to resolve the above described problem, Japan Patent Application Publication JP-A-10-123816 discloses a developing unit in which the quantity of developer contained on the first agitation transport member side can be balanced with the quantity of developer contained on the second agitation transport member side. In this developing unit, a quantity of developer contained in the second agitation transport member side will be moved to the first agitation transport member side by taking one of the following measures, for instance. One measure is forming a sloping base on a housing so that the first agitation transport member side can be arranged below the second agitation transport member side. Another measure is adjusting the amount of the developer transported between these two agitation transport members by changing the size of an opening formed on the partition plate that is arranged between these two agitation transport members in the horizontal direction.

However, when the above described former measure is taken, the first agitation transport member will be completely covered with developer. Thus, the agitation property and the transport property of the developer will be extremely degraded near the surface of the first agitation transport member. On the other hand, when the latter measure is taken, highly adjustable capabilities cannot be obtained. Thus it is difficult to achieve a balance between the amount of developer contained in the first agitation transport member side and the amount of developer contained in the second agitation transport member side, except for a low speed image forming device that outputs a small number of printed sheets per unit time.

In contrast, Japan Patent Application Publication JP-A-2002-148915 discloses a developing unit in which the developing roller is arranged diagonally above the first agitation transport member and facing the second agitation transport member. More specifically, in this developing unit, the first agitation transport member and the second agitation transport member are arranged to be parallel to each other, and separated by a partition plate which has openings on both ends in the axial direction. Here, the developer is drawn from the first agitation transport member side onto the developing roller that is arranged diagonally above the first agitation transport member. In addition, the developer will be peeled off from the developing roller after passing the developing region, and returned back to the first agitation transport member side. However, if a structure in which four developing units corresponding to four color developers, i.e., the yellow (Y) developer, the magenta (M) developer, the cyan (C) developer, and the black (K) developer, are respectively arranged parallel to each other in the horizontal direction, just like a tandem full color printer, the horizontal size thereof will be increased. Therefore, it is difficult to miniaturize the developing unit. On the other hand, if the horizontal size of the image forming device needs to be reduced, the arrangement of the developing roller has to be closely similar to that described in Japan Patent Application Publication JP-A-10-123816. In this case, the above described problem regarding the invention described in the publication will occur.

In the above described conventional developing unit, it is desirable to provide a unit that makes it easy for the developer to fall along the sloping surface in order to supply the developer peeled off from the developing roller to the first agitation transport unit. However, even if only this type of unit is applied to a conventional developing device, the number of components will be increased. Thus, it will be difficult to precisely arrange and fix these components in the interior of the housing. Accordingly, the ability to assembly the developing unit will be degraded.

In view of the above, it will be apparent to those skilled in the art from this disclosure that there exists a need for an improved developing unit in an image forming device which makes it easy to arrange and fix a member to guide the developer peeled off from the developing roller to the first agitation transport member in a housing, improves the ability to assemble the developing unit, and inhibits an imbalance in the amount of the developer contained on the first agitation transport member side and on the second agitation transport member side caused when the developer peeled off from the developing roller is supplied to the second agitation transport member side. This invention addresses this need in the art as well as other needs, which will become apparent to those skilled in the art from this disclosure.

SUMMARY OF THE INVENTION

In accordance with a first aspect of the present invention, a developing unit is comprised of a developing roller, a first agitation transport member, a second agitation transport member, a bulkhead, and a housing. Here, the developing roller can support developer on the surface thereof. The first agitation transport member is configured to simultaneously agitate and transport the developer in the axial direction and supply the developer to the developing roller. The second agitation transport member is arranged to be parallel to the first agitation transport unit in an approximately horizontal direction, and configured to circulate and transport the developer with the first agitation transport member and mix the developer with externally supplied developer. The bulkhead is comprised of a partition member that is arranged between the first agitation member and the second agitation member in the horizontal direction and which connects the first agitation transport member side and the second agitation transport member side at a region of the partition member in the axial direction, and a guide member that is formed to be integral with the partition member and guide the developer peeled off from the surface of the developing roller to the first agitation transport member. At least the first agitation transport member, the second agitation transport member, and the bulkhead member are arranged in the interior of the housing, and the bulkhead can be arranged in the housing such that there is no space between first and second ends of the bulkhead and the housing.

According to the first aspect of the present invention, in this unit, the guide member and the partition member are formed to be integral with each other. Therefore, the number of components can be reduced, and it will be easy to arrange and fix the guide member in the housing. Accordingly, the ability to assemble the developing unit can be enhanced.

In addition, in this developing unit, developer peeled off from the developing roller is guided by the guide member and reliably retrieved in the first agitation transport unit member. Therefore, it is easy to maintain a balance between the amount of the developer contained in the first agitation transport member side and the amount of the developer contained in the second agitation transport member side.

In the present invention, directional terms such as "upper," "lower," "vertical," or "horizontal" mean the direction based on the normal usage situation of the image forming device for which a developing unit in accordance with the present invention is applied. In addition, a configuration in which there is "no space" between the bulkhead and the housing includes a state in which the bulkhead and the housing are in sufficient contact with each other such that toner will be prevented from moving back and forth between the first agitation transport member side and the second agitation transport member side, except for in a region of the partition member in the axial direction. More specifically, the bulkhead and the housing are jointed or formed to be integral with each other as described below.

In addition, the developing roller may be completely installed in the interior of the housing, or a portion of the developing roller may be arranged on the exterior of the housing.

In accordance with a second aspect of the present invention, in the developing unit according to the first aspect of the present invention, the developing roller is arranged above the first agitation transport member and the second agitation transport member. In addition, the bulkhead is formed so that the guide member is arranged above the partition member, and either the first end on the partition member side thereof or the second end on the guide member side thereof is formed to be integral with the housing.

According to the second aspect of the present invention, either the partition member or the guide member is formed to be integral with the housing. Therefore, the number of components can be further reduced, and it will be easy to arrange and fix the components in the housing.

In accordance with a third aspect of the present invention, in the developing unit according to the second aspect of the present invention, the bulkhead is formed so that the first end or the second end of the bulkhead not integrally formed with the housing can be joined with the housing. In this device, either of the ends of the bulkhead member can be joined with the housing. Therefore, the bulkhead can be attached to the housing without any space therebetween.

In accordance with a fourth aspect of the present invention, in the developing unit according to the third aspect of the present invention, the housing is comprised of an upper housing member that is arranged on the upper side thereof and the lower housing member that is arranged on the bottom side thereof and attached to the upper housing member. In addition, the bulkhead is formed so that the partition member is formed in a plate shape extending in the vertical direction, and the second end is formed to be integral with the upper housing member.

According to the fourth aspect of the present invention, the direction in which the partition member extends and the attachment direction of the upper housing unit with respect to the lower housing unit are the same. Therefore, a developing unit that can be obtained that is easy to assembly.

As described above, according to the present invention, the guide member and the partition member are formed to be integral with each other, and thus the number of components can be reduced. Accordingly, it is possible to easily arrange and fix the guide member in the interior of the housing. Because of this, the assembly of the device is enhanced as a whole.

In addition, according to the present invention, the developer peeled off from the developing roller is guided to the guide member and reliably retrieved in the first agitation transport unit side. Therefore, it is easy to keep a balance between the amount of the developer contained in the first agitation transport member side and the amount of the developer contained in the second agitation transport member side.

These and other objects, features, aspects, and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

First Embodiment

Figure 1:
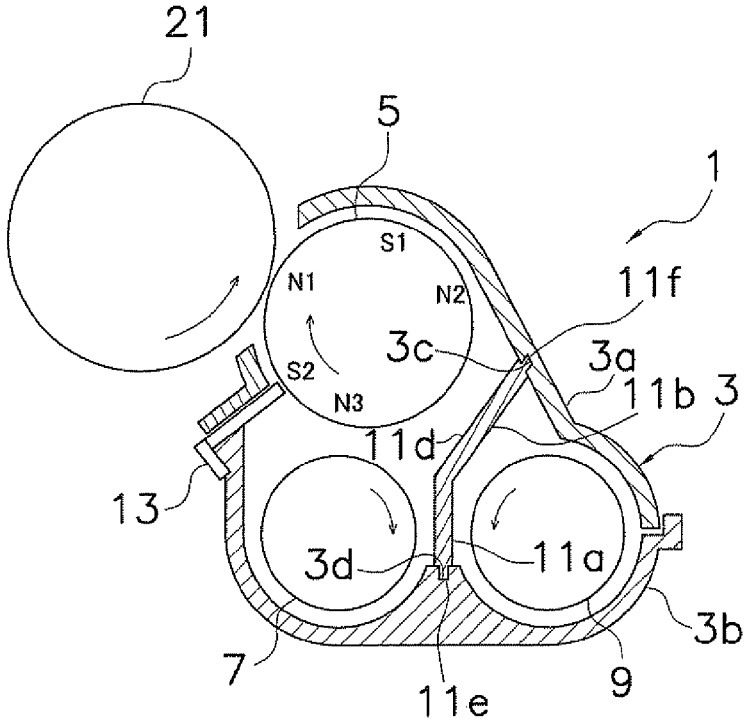
FIG. 1 is a vertical cross-section diagram showing a developing device in accordance with a first embodiment of the present invention.
Figure 2:
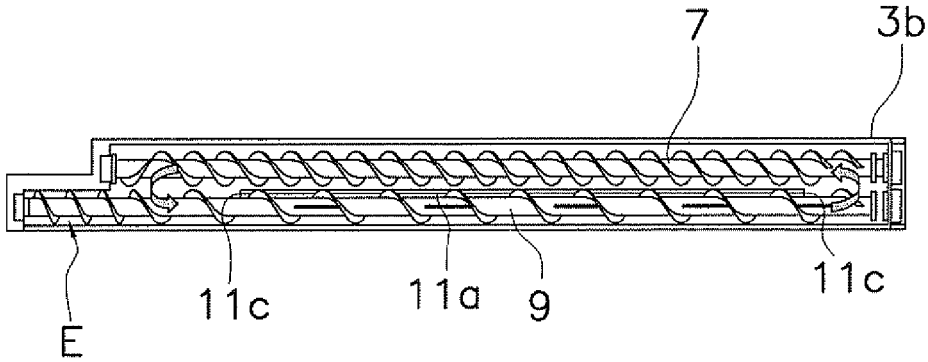
FIG. 2 is a top partial interior perspective view of the developing device in accordance with the first embodiment of the present invention.

FIGS. 1 and 2 show diagrams of a developing unit 1 in accordance with a first embodiment of the present invention.

The developing unit 1 is a unit applied to a tandem full color printer (not shown in the figure), and arranged to be adjacent to a photosensitive drum 21 installed in the full color printer. The developing unit 1 is comprised of a housing 3, a developing roller 5, a first agitation transport member 7, a second agitation transport member 9, a bulkhead 11 comprised of a partition member 11*a* and a guide member 11*b*, and a blade 13.

The housing 3 is a member that forms a portion of the chassis of the developing unit 1. The housing 3 is primarily comprised of an upper housing member 3*a*, and a lower housing member 3*b* attached to the upper housing member 3*a*. In addition, the housing 3 includes joint races 3*c* and 3*d* which join and attach the bulkhead 11 thereon. Also, the developing roller 5, the first agitation transport member 7, the second agitation transport member 9, and the bulkhead 11 are arranged in the interior of the housing 3.

The developing roller 5 is a rotational body which can attach developer onto the surface thereof. As shown in FIG. 1, five magnetic poles N1, N2, N3, S1, and S2 are fixed in the inside of the developing roller 5. The magnetic pole N3 is a drawing magnetic pole that draws the developer, and the magnetic pole N2 is a peel-off magnetic pole that peels off the developer from the surface of the developing roller 5.

In addition, the developing roller 5 is arranged in the interior of the housing 3 so that the lower end thereof is located above the upper ends of the agitation transport members 7 and 9, and the rotary shaft thereof is located between the agitation transport members 7 and 9 in the horizontal direction.

The first agitation transport member 7 is configured to simultaneously agitate and transport the developer in the axial direction and supply developer to the developing roller 5.

The second agitation transport member 9 is arranged to be parallel to the first agitation transport member 7 in the horizontal direction. The second agitation transport member 9 can circulate and transport developer in cooperation with the first agitation transport member 7, and mix the developer contained in the housing 3 with the toner replenished from a hopper (not shown in the figures) installed in the full color printer. Here, the toner is replenished from the hopper through a region E shown in FIG. 2.

The bulkhead 11 includes the partition member 11*a* and the guide member 11*b*. The partition member 11*a* divides the two agitation transport members 7 and 9 in the horizontal direction and the guide member 11*b* guides the toner peeled off from the developing roller 5 to the first agitation transport member 7 side. Here, the partition member 11*a* and the guide member 11*b* are integrally formed with each other.

The partition member 11*a* is arranged between the first agitation transport member 7 and the second agitation transport member 9 in the horizontal direction. In addition, as shown in FIG. 2, openings 11*c* are formed on both ends of the partition member 11*a* in the axial direction. The openings 11*c* connect the first agitation transport member 7 side with the second agitation transport member 9 side.

The guide member 11*b* has a sloping surface 11*d* that guides the developer peeled off from the surface of the developing roller 5 to the first agitation transport member 7 side.

The partition member 11*a* is formed to be a plate shape that extends in the vertical direction when it is attached to the housing 3. Also, a joint projection 11*e* that can be joined with the joint race 3*d* formed in the lower housing member 3*b* is formed on the end (hereinafter called the first end) of the partition member 11*a*. On the other hand, a joint projection 11*f* that can be joined with the joint race 3*c* formed in the upper housing member 3*a* is formed on the end (hereinafter called the second end) of the guide member 11*b*. With this structure, the bulkhead 11 can be arranged in the housing 3 without any space between the housing 3 and the first and second ends of the bulkhead 11.

The blade 13 controls the thickness of the layer of the drawn toner.

The operation of the developing unit 1 is hereinafter described in detail.

When an image forming operation is requested in a color printer, the developer contained in the housing 3 is drawn by the drawing magnetic pole N3 of the developing roller 5, and the blade 13 controls thickness of the layer of the developer and charges the developer. Then, a portion of the developer is supplied to the photosensitive drum 21 from the developing region.

The developer remaining on the developing roller 5 is peeled off by the peel-off magnetic pole N2 after it passes the developing region. Then the developer drops onto the sloping surface 11*d* of the bulkhead 11 and is guided to the agitation transport member 7 side along the sloping surface 11*d*.

The retrieved developer is circulated and transported in the interior of the housing 3 through the openings 11*c* formed on the bulkhead 11 by means of the rotary drive of the first agitation transport member 7 and the second agitation transport member 9, and mixed with the toner replenished from the hopper in the second agitation transport member 9.

In the above described developing unit 1, the bulkhead 11 is joined with the upper and the lower housing members 3*a* and 3*b*. Therefore, the guide member and the partition member are formed to be integral with each other. Thus, the number of components can be reduced. Accordingly, it becomes easy to arrange and fix the guide member in the housing, and the ability to assembly the developing unit 1 can be enhanced.

In addition, in the developing unit 1, the developer peeled off from the developing roller 5 will be reliably guided to and retrieved on the first agitation transport side through the guide member. Therefore, it will be easy to maintain a balance between the amount of the developer contained in the first agitation transport member side and the amount of the developer contained in the second agitation transport member side.

Second Embodiment

A second embodiment of the present invention will now be described by focusing on the differences with the above described first embodiment of the present invention. In view of the similarity between the first and second embodiments, the parts of the second embodiment that are identical to the parts of the first embodiment will be given the same reference numerals as the parts of the first embodiment. Moreover, the descriptions of the parts of the second embodiment that are identical to the parts of the first embodiment may be omitted for the sake of brevity.

Figure 3:
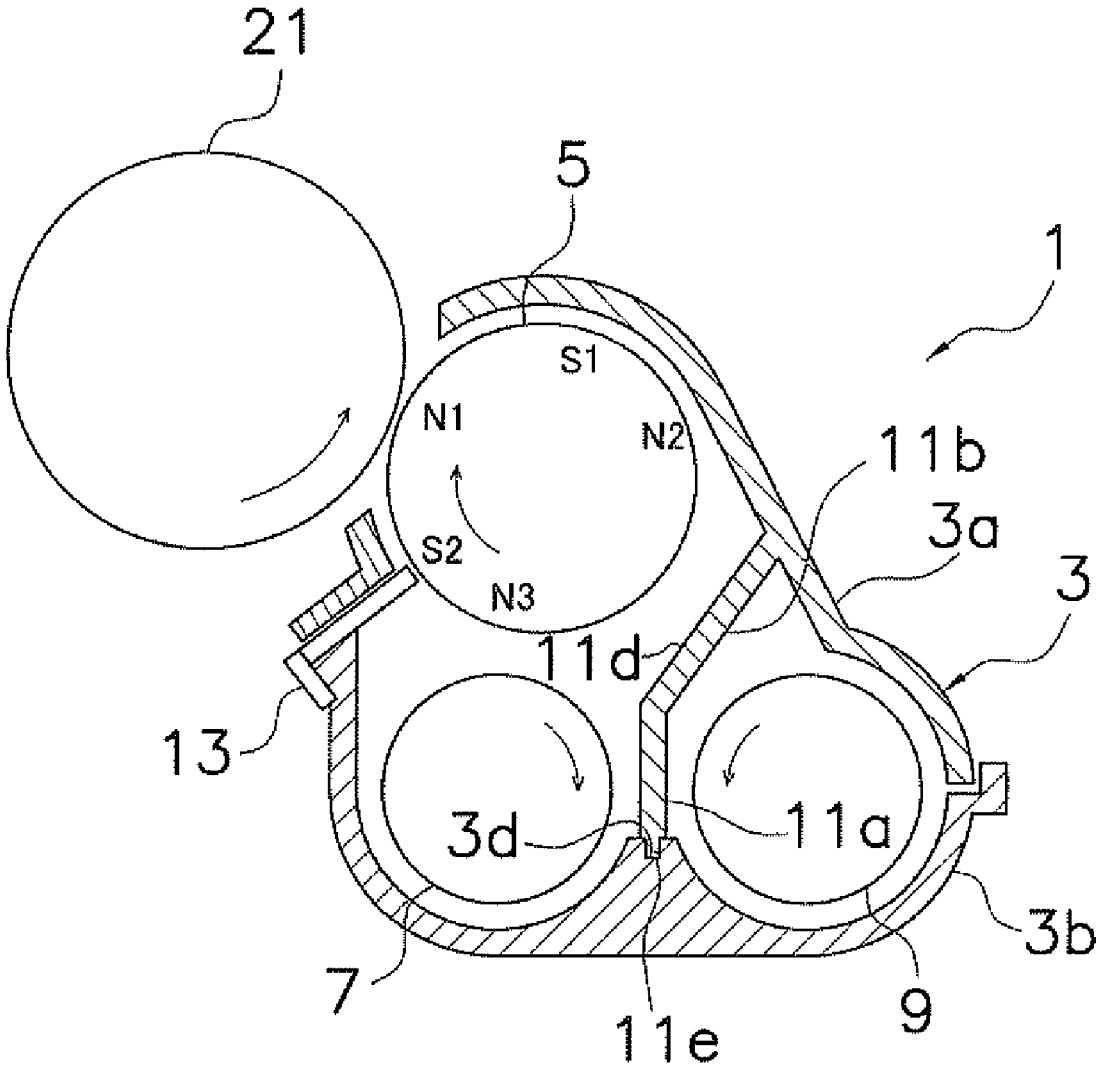
FIG. 3 is a vertical cross-section diagram showing a developing device in accordance with a second embodiment of the present invention.

FIG. 3 shows a developing unit 1 in accordance with the second embodiment of the present invention.

In this developing unit 1, the bulkhead 11 is formed to be the same as that of the first embodiment of the present invention, except that one end of the guide member 11*b* is formed to be integral with the upper housing member 3*a* at (i.e., the second end).

In this developing unit 1, the direction in which the partition member 11*a* extends and the direction in which the upper housing member 3*a* is attached to the lower housing member 3*b* are the same. Therefore, the ability to assemble the device can be further enhanced.

Alternative Embodiment

The second end of the bulkhead may be formed to be integral with the lower housing member. In this case, it is desirable to form the first end of the bulkhead to be capable of being joined with the housing.

In addition, the developing unit in accordance with the present invention can be adapted to a tandem color printer as well as to any type of electrophotographic image forming devices, such as a single-drum color printer or a monochrome laser printer.

GENERAL INTERPRETATION OF TERMS

In understanding the scope of the present invention, the term "configured" as used herein to describe a component, section or part of a device includes hardware and/or software that is constructed and/or programmed to carry out the desired function. In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A developing unit, comprising:

a developing roller configured to support developer on the surface thereof;

a first agitation transport member configured to simultaneously agitate and transport the developer in the axial direction and supply the developer to the developing roller;

a second agitation transport member arranged to be parallel to the first agitation transport member in an approximately horizontal direction and configured to circulate and transport the developer with the first agitation transport member and mix the developer with externally supplied developer, the developing roller being arranged above the first agitation transport member and the second agitation transport member;

a bulkhead comprising a partition member arranged between the first agitation member and the second agitation member in the horizontal direction and configured to connect the first agitation transport member side and the second agitation transport member side at a region of the partition member in the axial direction, and a guide member integral with the partition member and configured to guide developer removed from the surface of the developing roller to the first agitation transport member, the bulkhead is configured such that the guide member is arranged above the partition member; and a housing assembly including an upper housing member on the upper side of the housing assembly and a lower housing member on the lower side of the housing assembly, the lower housing member being attachable to the upper housing member, the housing assembly being arranged to accommodate at least the first agitation transport member, the second agitation transport member, and the bulkhead, the bulkhead being arranged such that there are no gaps between first and second ends of the bulkhead and the housing assembly, and either a first end on the partition member side thereof or a second end on the guide member side thereof is formed to be integral with the housing assembly.

2. The developing unit according to claim 1, wherein the bulkhead is configured such that the first end or the second end thereof that is not integrally formed with the housing assembly can be joined with the housing assembly.

3. The developing unit according to claim 1, wherein the bulkhead is configured such that the partition member is formed in a plate shape that extends in the vertical direction and the second end is formed to be integral with the upper housing member.

* * * * *